US005388271A

United States Patent [19]

Sessoms

[11] Patent Number: 5,388,271

[45] Date of Patent: Feb. 14, 1995

[54] INSULATED ATHLETIC UNDERGARMENT WITH SEGMENTALLY ARRANGED SUPPLEMENTAL INSULATION FOR COLD WEATHER PROTECTION

[76] Inventor: Robert W. Sessoms, 107 Tudor Ct., Goodlettsville, Tenn. 37072

[21] Appl. No.: 29,405

[22] Filed: Mar. 10, 1993

[51] Int. Cl.[6] ..... A41D 13/00; A41D 1/04

[52] U.S. Cl. ..... 2/115; 2/113; 2/2

[58] Field of Search ..... 2/2, 267, 115, 94, 16, 2/81, 125, 92, 247, 113, 69

[56] References Cited

U.S. PATENT DOCUMENTS

| | | | |
|---|---|---|---|
| 1,777,878 | 10/1930 | Evans | 2/2 |
| 3,135,961 | 6/1964 | Roderick | 2/2 |
| 3,945,042 | 3/1976 | Lobo | 2/2 |
| 3,991,420 | 11/1976 | Savarino | 2/2 |
| 4,441,211 | 4/1984 | Donzis | 2/2 |
| 4,507,801 | 4/1985 | Kavanagh et al. | 2/2 |
| 4,870,706 | 10/1989 | Ketcham et al. | 2/2 |
| 5,007,108 | 4/1991 | Laberge et al. | 2/2 |

*Primary Examiner*—Clifford D. Crowder
*Assistant Examiner*—Amy B. Vanatta
*Attorney, Agent, or Firm*—Richard C. Litman

[57] ABSTRACT

An article of insulated apparel, the integral continuous parts of which include a body and appendages formed of an insulated, resilient fabric material. The article of insulated apparel further includes segmentally arranged supplemental insulation for insulating less mobile regions of a user's body, such as the upper and lower arms, and the upper and lower legs. The midriff and the upper torso may be insulated as well. By providing segmentally arranged supplemental insulation, that is, discontinuity in supplemental insulation over more mobile regions of the user's body, such as, for instance, the shoulder, elbow, and wrist regions, the user is permitted to move more freely.

19 Claims, 3 Drawing Sheets

INSULATED ATHLETIC UNDERGARMENT WITH SEGMENTALLY ARRANGED SUPPLEMENTAL INSULATION FOR COLD WEATHER PROTECTION

BACKGROUND OF THE INVENTION

1. Field of the Invention

The present invention relates generally to articles of insulated apparel and more particularly, to an insulated undergarment comprised of a body and appendages continuously and integrally formed of insulated, resilient fabric material and having segmentally arranged supplemental insulation for insulating less mobile regions of a user's body.

2. Description of the Prior Art

Numerous activities are performed during the cold winter season. Availability of specialized apparel to be worn while participating in certain of these activities is somewhat limited. Some measures have been taken to protect participants of certain activities from the cold ambient environment. One such measure includes controlling the environment in which the activity is being performed, for instance, enclosing a stadium to form a "dome" for insulating participants, such as football players, from the cold ambient environment. However, domes are very costly and time consuming to construct and therefore, fail to provide an instant solution to an immediate problem. Focusing on a solution to independently protect each participant from the cold certainly provides a more economical short term solution. Moreover, such a form of protection would be useful in activities, such as hunting and fishing, where providing an enclosure is impractical.

It is not uncommon for participants of winter activities performed in a cold ambient environment to wear several layers of clothing. Unfortunately, the layering of clothing is typically continuous over the more movable regions of the user's body, such as the shoulders, elbows, and wrists, greatly restricting the ability of the user to move freely. A single insulated undergarment having segmentally arranged supplemental insulation for insulating less mobile regions of a user's body economically protects each participant independently from other participants regardless of the environment in which the activity is performed.

Garments for protecting certain regions of a user's body are known. For instance, U.S. Pat. No. 3,135,961, issued Jun. 9, 1964 to Marshall E. Roderick, discloses a shirt-like garment having a singular pad to protect the wearer's chest or abdomen. Another protective article of clothing is shown in U.S. Pat. No. 3,945,042, issued Mar. 23, 1976 to Alfred D. Lobo, which discloses a protective garment for skaters, and the like, comprising a fabric layer upon which a plurality of foamed plastic cylinders may be removably fixed. A cover is provided over the cylinders so that the garment has a conventional appearance when worn. U.S. Pat. No. 4,507,801, issued Apr. 2, 1985 to Frank J. Kavanagh et al., shows yet another protective garment having a plurality of pockets for receiving pads formed to fit the wearer. The pads protect the wearer's spine, shoulders, and ribs. Additionally, U.S. Pat. No. 4,870,706, issued Oct. 3, 1989 to Kenneth E. Ketcham et al., describes a shirt-like protective garment having air inflatable pads positioned in fabric compartments located adjacent the wearer's spine, shoulders, and ribs. Similarly, U.S. Pat. No. 5,007,108, issued Apr. 16, 1991 to Raymond Laberge et al., provides a chest protector having a plurality of overlapping padding sections capable of covering the entire arm. The wearer's torso is also shielded with protective padding in this formidable appearing piece of clothing.

The aforementioned patents disclose protective garments which are generally bulky and reduce the freedom of mobility of the user. Further, the protective garments disclosed provide protection against trauma. Unlike the aforementioned prior art, applicant's instant invention is a undergarment which protects the user from the cold ambient environment and which provides supplemental protection against the cold ambient environment for less mobile regions of the user's body.

None of the above patents, taken either singly or in combination, is seen to describe the instant invention as claimed.

SUMMARY OF THE INVENTION

The present invention relates to articles of insulated apparel comprising a body and appendages continuously and integrally formed of an insulated, resilient fabric material. Segmentally arranged supplemental insulation for insulating less mobile regions of the user's body, such as the user's upper and lower, arm, leg, and torso regions, is supported by the insulated, resilient fabric material. The segmentally arranged supplemental insulation is discontinuous over the more movable regions of the user's body, such as the shoulder, elbow, and wrist regions, thus permitting the user to move these regions with greater freedom. Further, the segmentally arranged supplemental insulation is discontinuous over regions of the user's body which may be protected by protective gear, such as shoulder pads, so as not to interfere with the fit of the protective gear. The insulated, resilient fabric material insulates the mobile regions as well as the less mobile regions of the user's body against the cold ambient environment. The segmentally arranged supplemental insulation provides insulation against the cold ambient environment in addition to the insulated, resilient fabric material. Alternatively, a highly resilient, lightweight, fabric is employed in substitution of the insulated, resilient fabric material in areas of the garment which are associated with the more mobile regions of the user's body, such as the shoulder and elbow regions, thereby providing even greater mobility. Yet as another alternative, the entire undergarment may be covered with a nylon material to give it a wind breaking capability and thus, reduce the risk of wind chill.

Accordingly, it is a principal object of the present invention to provide an article of insulated apparel which comprises a body and appendages continuously and integrally formed of an insulated, resilient fabric material which supports segmentally arranged supplemental insulation for insulating less mobile regions of the user's body.

Another object is to provide discontinuity in the segmentally arranged insulation over the more mobile regions of the user's body, thus permitting the user to move these regions more freely and over the regions of the user's body which encounter protective gear.

Yet another object is to incorporate highly resilient, lightweight, fabric into areas of the garment which are associated with the more mobile regions the user's body thereby providing even greater mobility.

Another object is to cover the entire undergarment with a nylon material to give it a wind breaking capability.

It is an object of the invention to provide improved elements and arrangements thereof in an apparatus for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
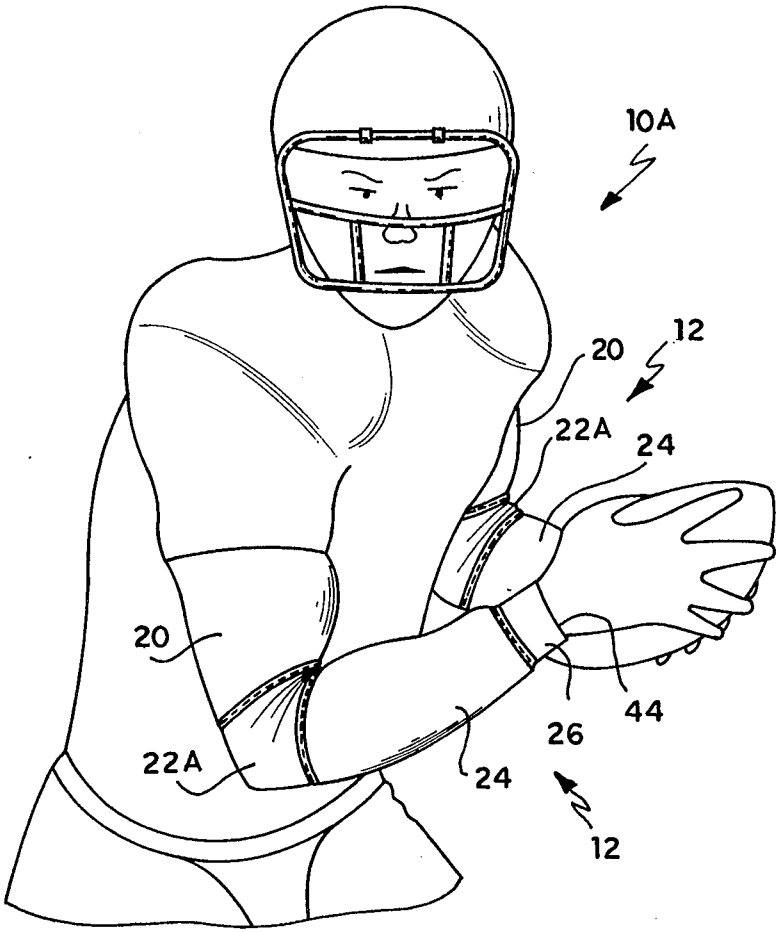
FIG. 1 is an environmental perspective view of an insulated article of insulated apparel according to the present invention.

The present invention, as shown in FIG. 1, is an article of insulated apparel 10*a* worn by a user 100, such as the sports figure shown. This article of insulated apparel 10*a* is worn predominantly covered by an outer layer of clothing, such as the jersey 102 worn by the user 100. The article of insulated apparel 10*a* is in the form of a long sleeve shirt-like article comprising appendages, such as the sleeves 12 shown, which are substantially continuous with a body 14.

Figure 2:
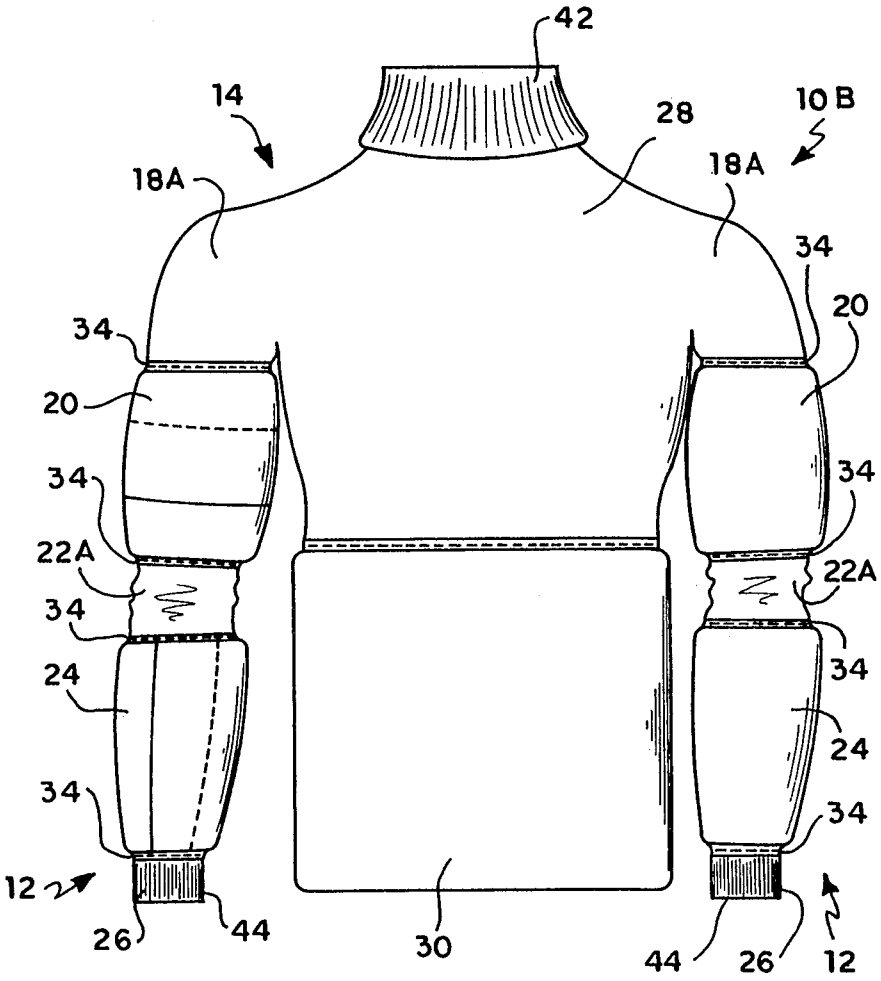
FIG. 2 is a front elevational view of an alternative embodiment of the article of insulated apparel showing overlapping portions of the upper and lower arms in phantom lines.
Figure 3:
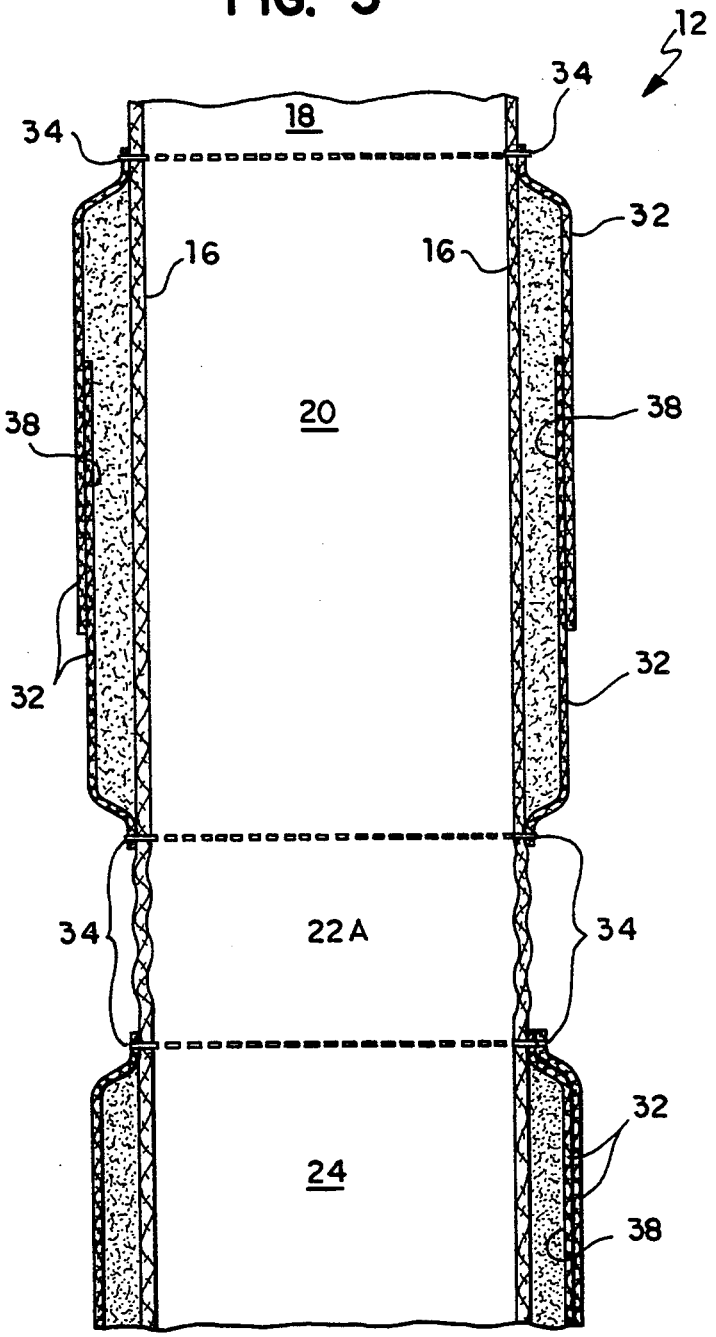
FIG. 3 is a partial cross sectional view of a sleeve of the article of insulated apparel shown in FIG. 2.
Figure 4:
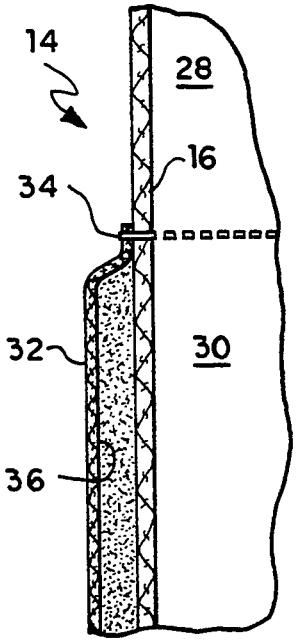
FIG. 4 is a partial cross sectional view of the midriff region of the article of insulated apparel shown in FIG. 2.

Referring the alternative embodiment shown in FIGS. 2 through 4, the sleeves 12 and body 14 are fabricated of a resilient, thermally insulated, first ply of fabric material 16 which is comfortable to the user 100 and porous to permit moisture to escape therethrough, thereby keeping the user's body dry, and resistant to the cold ambient environment. The material 16 may be natural, such as wool or cotton, or synthetic, such as nylon or polyester, or a combination thereof. One such fabric which is suitable for fabricating the body and sleeves is Synchilla fabric manufactured by Pentagonia of Ventura, Calif. Another suitable fabric is Polartec Series 100 fabric manufactured by Malden Mills Industries, Incorporated of Lawrence, Mass. This machine washable fabric has a 100% fiber content. The face of this fabric is surface finished as a low-pill, low velour pile to provide comfort for the user 100. These fabrics have extremely fast wicking/siphoning abilities to keep the user 100 feeling dry under active conditions and its anti-microbial prevents bacterial growth to help keep this fabric looking and smelling fresh. Alternatively, Malden Mills Industries, Incorporated offers Polartec Series 200 and 300 fabric which progress in fabric thickness and weight and thus, offer greater insulation to the user 100 form the cold ambient environment. It should be noted that though Polartec Series 100 is a suitable fabric for the first ply of fabric material 16, similar fabrics may be employed.

Figure 5:
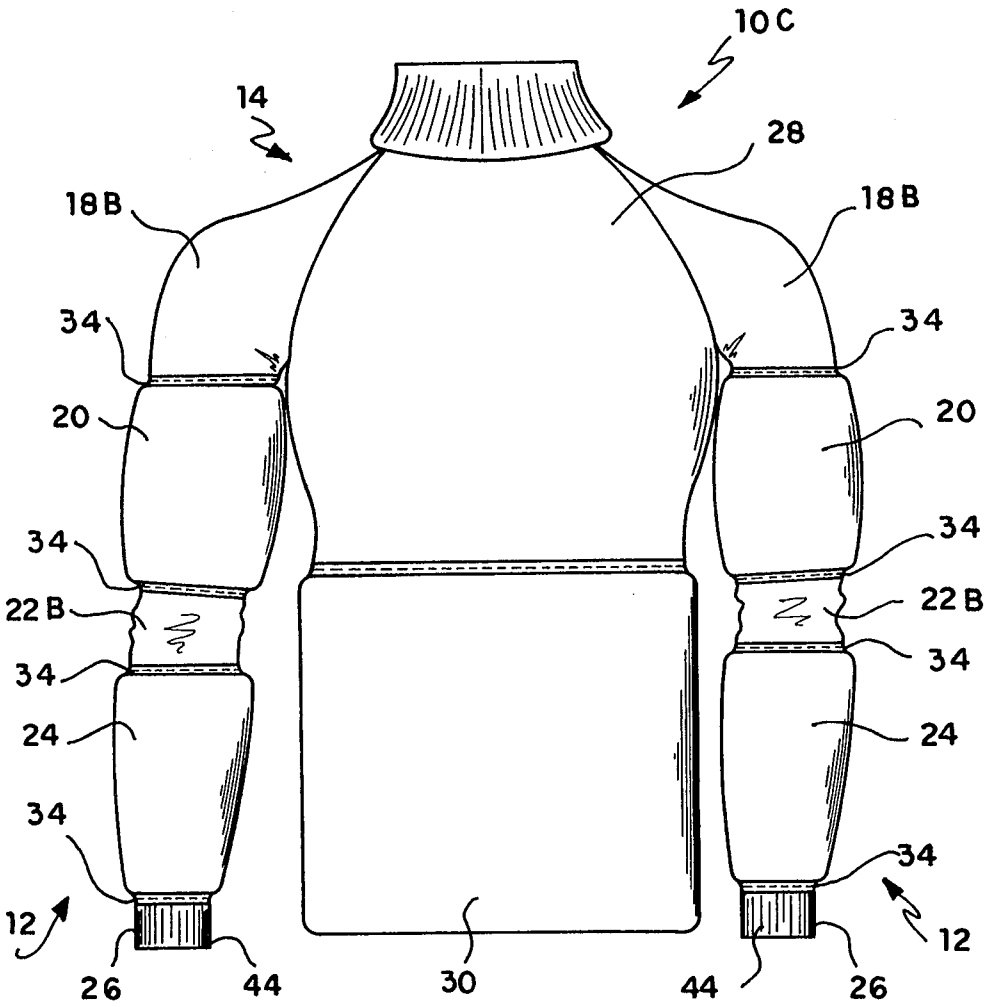
FIG. 5 is a front elevational view of yet another alternative embodiment of the article of insulated apparel having highly elastic shoulder and elbow regions.

Unlike the first two embodiments, FIG. 5 shows yet another alternative embodiment of the insulated article of apparel 10*c* having elbow regions 22*b* and shoulder regions 18*b* which are formed of a single ply of fabric material which is highly elastic and which has a nominal thickness of as to offer little to no restriction of the movement of the user's elbows and shoulders. Lycra Spandex manufactured by E. I. DuPont De Nemours and Company of Wilmington, Del. is an example of a fabric which could accommodate these regions 18*b*, 22*b*.

Areas or regions of each of the articles of apparel 10*a*, 10*b*, 10*c* associated with less mobile regions of the user's body, namely: the upper arm regions 20, each extending from a point below a respective shoulder region 18*a*, 18*b* to a point above a point above a respective elbow region 22*a*, 22*b*; the lower arm region 24 extending from a point below a respective elbow 22*a*, 22*b* region to a point above a respective wrist region 26; and the midriff region 30 extending from a point below the chest region 22, include segmentally arranged supplemental insulation I, such as a pile, a batting, a down fill, a polyester fill, a fiberfill, or some other known material which provides supplemental protection for the user 100 against the cold ambient environment. The supplemental insulation I should be lightweight, thin, and flexible. One such insulating fiber for use as the segmentally arranged supplemental insulation is Micro-loft down-like insulation manufactured by E. I. Du Pont De Nemours and Company of Wilmington, Del. Micro-loft is produced under a process combining microdenier fibers to render a comfortable down-like insulation which keeps the user 100 warmer than conventional down insulation. Micro-loft blocks radiant heat loss, while greatly reducing convective heat loss.

Preferably, the segmentally arranged supplemental insulation I may be loosely arranged between the first ply of fabric material 16 and a second ply of fabric material 26, fixedly attached to the first ply of fabric material 16, such as by the stitching 34 shown, so as to form a closed pouch 36, as is shown in FIG. 4. Alternatively, the first ply of fabric material 16 and a second ply of fabric material 26 may be stitched so as to form a pocket 38 having a closure 40, as is shown more particularly in FIGS. 2 and 3. Similar to the first ply of fabric material 16, the second ply of fabric material 32 may be also be of a natural fabric, a synthetic fabric, or a combination thereof. Alternatively, the second ply of fabric material 32 may be a wind resistant material, such as Supplex Microsupplex also manufactured by E. I. Du Pont De Nemours and Company of Wilmington, Del.

Referring more particularly to FIGS. 1, 2 and 5, the segmentally arranged supplemental insulation I is discontinuous in the vicinity of the elbow region 22*a*, 22*b* and shoulder region 18 to permit the user 100 to move freely both the his or her elbows and the shoulders. Moreover, the segmentally arranged supplemental insulation is discontinuous over regions of the user's body which are be protected by protective gear, such as shoulder pads, so as not to interfere with the fit of the protective gear. In addition to the segmentally arranged supplemental insulation I, the articles of apparel 10*a*, 10*b*, 10*c* include a neck band, such as the turtle neck 42 shown, and wrist bands 44 to prevent the user 100 form being exposed to the cold ambient environment about the neck and the wrist, thus further insuring that the user 100 remains warm. The turtle neck 36 and the wrist bands 36 are each fabricated of a material which is highly absorbent and highly elastic, such as Lycra Spandex. Such a fabric is capable of absorbing the user's body moisture and maintaining a close tolerance to the user's neck and wrist.

The articles of apparel 10*a*, 10*b*, 10*c* insulate the entire upper torso of the user 100 and include the segmentally arranged supplemental insulation I limited to the less mobile regions or areas of the user's body, thus enable the user 100 to move more freely than would multiple layers of clothing or even a single garment which and an integral insulation material or padding which was continuous over the entire garment.

In each of the embodiments shown in the figures, the segmentally arranged insulation material is excluded from the chest region 28 and upper back region 46 opposite the chest region 28 so as not to interfere with protective equipment, such as conventional shoulder pads (not shown) used by the football player shown in FIG. 1, worn over the article of apparel 10*a*, 10*b*, 10*c* and under the jersey 102. It should be noted that any portion of the garment may be covered with a nylon material to give it a wind breaking capability and thus, reduce the risk of wind chill. Preferably, the garment 10*a*, 10*b*, 10*c* includes an outer shell which is water-resistant yet breathable. The outer shell may be color coordinated to match team colors. Alternatively, the garment 10*a*, 10*b*, 10*c* may be coated with a water-resistant coating, such as $H_2NO$ manufactured by Pentagonia of Ventura, Calif.

It is also to be understood that the present invention is not limited to the embodiments described above, but encompasses any and all embodiments within the scope of the following claims.

I claim:

1. An article of insulated apparel comprising:

a body fabricated substantially of an insulated, resilient fabric material;

an appendage fabricated substantially of an insulated, resilient fabric material continuous and integral with said body;

a low mobility area corresponding to a low mobility region of a user's body;

a high mobility area corresponding to an articulated joint of the user's body; and a segmentally arranged supplemental insulation supported by said low mobility area, said segmentally arranged supplemental insulation defining a continuous encirclement of said low mobility area, whereby said low mobility area provides supplemental insulation to protect the low mobility region of the user's body against a cold ambient environment and enables the high mobility region of the user's body to move freely.

2. The article of insulated apparel according to claim 1, wherein said low mobility area includes means for defining a pocket for carrying said segmentally arranged insulation therein.

3. The article of insulated apparel according to claim 1, further including a light weight, highly elastic fabric continuous with said insulated, resilient fabric material; said light weight, highly elastic fabric defining said highly mobile area thereby providing greater mobility for the user.

4. The article of insulated apparel according to claim 1, further including two appendages wherein each of said appendages includes a sleeve having an upper arm region and a lower arm region spaced apart by an elbow region, and wherein said body includes a midriff region, and two shoulder regions, wherein said upper and lower arm regions, and said midriff region define said low mobility area and support said segmentally arranged insulation, and said elbow regions and said shoulder regions define said high mobility area and are capable of moving freely.

5. The article of insulated apparel according to claim 4, further including:

a neck band fabricated of an insulated, resilient fabric material continuous with said body; and a wrist band fabricated of an insulated, resilient fabric material continuous with said body, said wrist band being joined to said sleeve; whereby said neck band hugs the user's neck tightly so as to prevent cold ambient air from entering said article of insulated apparel about the user's neck, and whereby said wrist band hugs the user's wrist tightly so as to prevent cold ambient air from entering said article of insulated apparel about the user's wrist.

6. An article of insulated apparel to be worn by a user, the user having a plurality of low mobility regions separated by a plurality of articulated joints, said article of insulated apparel comprising:

a body fabricated substantially of an insulated, resilient fabric material;

a plurality of appendages each fabricated substantially of an insulated, resilient fabric material continuous and integral with said body;

a plurality of low mobility areas, each one of said plurality of low mobility areas corresponding to a respective one of the plurality of low mobility regions;

a plurality of high mobility areas, each one of said plurality of high mobility areas corresponding to a respective one of the plurality of articulated joints; and a segmentally arranged supplemental insulation supported by each one of said plurality of low mobility areas, said segmentally arranged supplemental insulation defining a continuous encirclement of said low mobility areas, whereby said plurality of low mobility areas provide supplemental insulation to protect the plurality of low mobility regions against a cold ambient environment and enable the plurality of articulated joints to move freely.

7. The article of insulated apparel according to claim 6, wherein said plurality of low mobility areas each include means for defining a pocket for carrying said segmentally arranged insulation therein.

8. The article of insulated apparel according to claim 6, further including a light weight, highly elastic fabric continuous with said insulated, resilient fabric material; said light weight, highly elastic fabric defining said plurality of highly mobile areas thereby providing greater mobility for the user.

9. The article of insulated apparel according to claim 6, wherein said body includes a midriff region, and two shoulder regions, and each of said appendages includes a sleeve having an upper arm region and a lower arm region spaced apart by an elbow region, wherein said midriff region, said upper arm region, and said lower arm region each define a respective one of said plurality of low mobility areas and support said segmentally arranged insulation, and said elbow regions and said shoulder regions define said plurality of high mobility areas and are capable of moving freely.

10. The article of insulated apparel according to claim 6, further including:

a neck band fabricated of an insulated, resilient fabric material continuous with said body; and two wrist bands fabricated of an insulated, resilient fabric material continuous with said body, each of said wrist bands being joined to a respective sleeve; whereby said neck band hugs a user's neck tightly so as to prevent cold ambient air from entering said article of insulated apparel about the user's neck and whereby said wrist bands each hug a user's wrists tightly so as to prevent cold ambient air from entering said article of insulated apparel about the user's wrists.

11. An insulated undergarment to be worn by a user, said insulated undergarment comprising:

a long sleeve shirt comprising two sleeves, each being substantially continuous with a body, said body including two shoulder regions spaced apart by a chest region and a midriff region extending below said chest region, said two sleeves each include an elbow region, a wrist region, an upper arm region extending from a point below said shoulder region to a point above said elbow region, and a lower arm region extending from a point below said elbow region to a point above said wrist region, said long sleeve shirt being fabricated of a resilient, thermally insulated, first ply of material; and a plurality of insulated pads integral therewith, one of said plurality of insulated pads being integral with each of said upper arm regions, said lower arm regions, and said midriff region, said insulated pads defining a continuous encirclement of said upper arm regions, said lower arm regions, and said midriff region, whereby said insulated padding provides supplemental insulation about the user's upper and lower arm regions, and midriff region, while said insulated padding is discontinuous in about the elbow and shoulder regions, permitting the user's shoulder, elbow, and wrist regions to move freely.

12. The insulated undergarment according to claim 11, wherein said first ply of material is porous, whereby moisture may escape therethrough keeping the user dry, and resistant to a cold ambient environment.

13. The insulated undergarment according to claim 11, wherein said first ply of material is a natural fiber.

14. The insulated undergarment according to claim 11, wherein said first ply of material is a synthetic fiber.

15. The insulated undergarment according to claim 11, wherein said insulated padding is loosely arranged between said first ply of material and a second ply of material.

16. The insulated undergarment according to claim 15, wherein said second ply of material is a natural fiber.

17. The insulated undergarment according to claim 15, wherein said second ply of material is a synthetic fiber.

18. The insulated undergarment according to claim 15, wherein said first ply of material is joined to said second ply of material by stitching.

19. The insulated undergarment according to claim 15, further including:

a neck band fabricated of an insulated, resilient fabric material continuous with said body; and two wrist bands fabricated of an insulated, resilient fabric material continuous with said body; whereby said neck band hugs a user's neck tightly so as to prevent cold ambient air from entering said insulated undergarment about the user's neck and whereby said wrist bands each hug a user's wrists tightly so as to prevent cold ambient air from entering said insulated undergarment about the user's wrists.

* * * * *